United States Patent [19]

Baier et al.

[11] Patent Number: 4,487,496

[45] Date of Patent: Dec. 11, 1984

[54] DEVICE FOR ADJUSTING THE LEVEL OF A DEVELOPING MIXTURE, WHICH CONSISTS OF A TONER AND CARRIER PARTICLES, ON A DEVELOPING ROLLER

[75] Inventors: Erich Baier, Suenzhausen; Rainer Köefferlein, Munich; Bernhard Schlageter, Ottobrunn, all of Fed. Rep. of Germany

[73] Assignee: Siemens Aktiengesellschaft, Berlin & Munich, Fed. Rep. of Germany

[21] Appl. No.: 375,457

[22] Filed: May 6, 1982

[30] Foreign Application Priority Data

May 13, 1981 [DE] Fed. Rep. of Germany ..... 3118995

[51] Int. Cl.[3] ..... G03G 15/09

[52] U.S. Cl. ..... 355/3 DD; 118/658

[58] Field of Search ..... 355/3 DD, 14 D; 118/262, 653, 656, 657, 658; 430/120, 122; 222/DIG. 1; 101/DIG. 13

[56] References Cited

U.S. PATENT DOCUMENTS

| | | | |
|---|---|---|---|
| 3,872,829 | 3/1975 | Rattin | 118/658 |
| 3,882,821 | 5/1975 | Katayama et al. . | |
| 3,929,098 | 12/1975 | Liebman | 355/3 DD X |
| 4,003,334 | 1/1977 | Samuels et al. | 118/658 |
| 4,112,870 | 9/1978 | Extra et al. | 118/657 X |
| 4,161,923 | 7/1979 | Abbott et al. | 118/658 |

*Primary Examiner*—John F. Gonzales

*Assistant Examiner*—J. Pendegrass

*Attorney, Agent, or Firm*—Hill, Van Santen, Steadman & Simpson

[57] ABSTRACT

In a developer station for an electrophotographic printing or copying machine, there is provided apparatus which serves to assure a uniform layer thickness and density of developer mix to be conducted by the developer roller to the inking gap with a charge image carrier. This apparatus comprises a stripping roller which is mounted for rotation in the same direction as the developing roller and is arranged adjacent to the developing roller for defining therebetween a nip area through which developer mix must pass in route to the inking gap. The stripping roller serves to define an even level thickness for the developer mix being conducted to the inking gap by stripping away an upper portion of the developer mix layer for return to the main body of developer mix disposed in the lower region of the developer station. A guide plate is disposed beneath the striping roller about the lower end of the developer roller for defining a gap opening between its lead edge and the stripping roller. The excess developer mix stripped by the stripping roller passes through this gap opening for return to the station lower region. The gap is sized such that a small accumulation of excess mix particles develops at the inlet to the nip area for compressing the developer mix layer at this point and, thus, effecting a uniform density of the mix layer passing through the nip area onto the inking gap.

5 Claims, 1 Drawing Figure

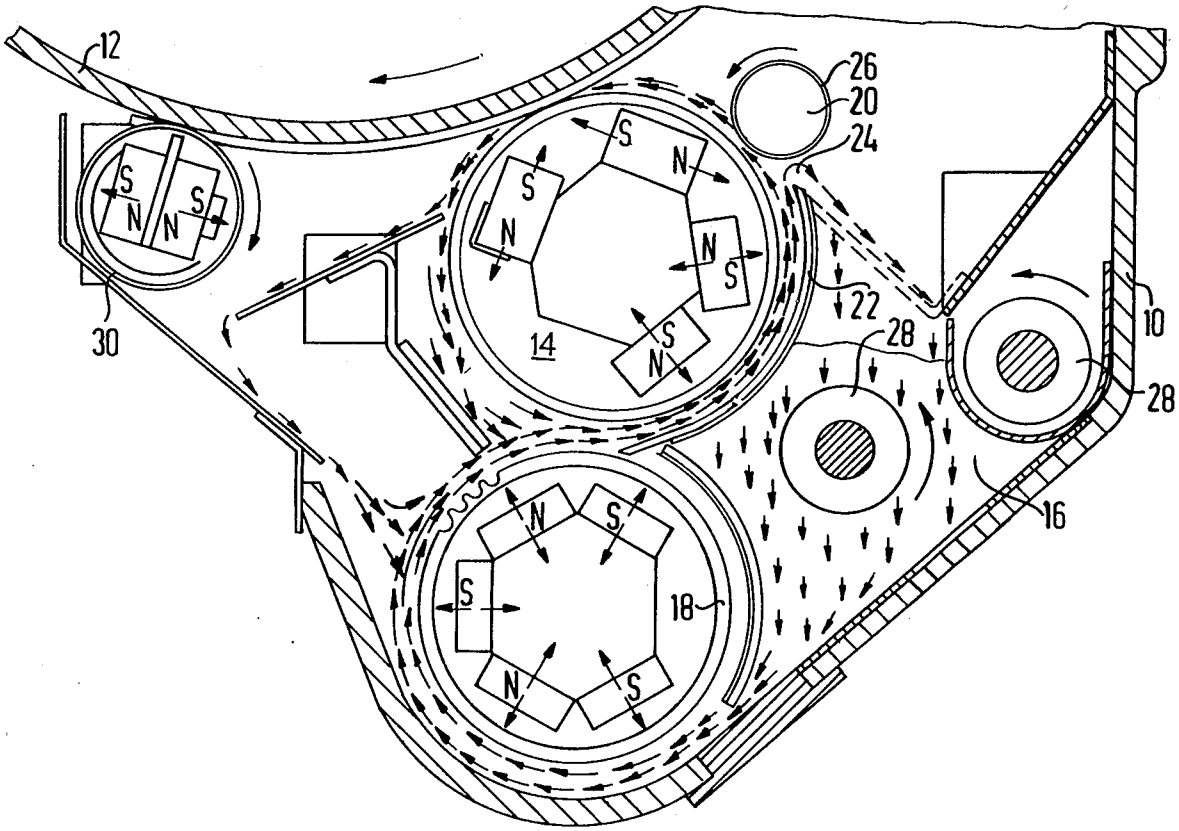
10
28
16
28
22
26
20
24
18
14
12
30
N
S

DEVICE FOR ADJUSTING THE LEVEL OF A DEVELOPING MIXTURE, WHICH CONSISTS OF A TONER AND CARRIER PARTICLES, ON A DEVELOPING ROLLER

RELATED APPLICATIONS

This application concerns subject matter which relates to the following commonly assigned U.S. patent applications, all filed May 6, 1982:

Ser. No. 375,458 entitled "Device For The Development Of Charge Images, Which Are Arranged On A Charge Image Carrier, With The Aid Of A Developing Mixture Consisting Of Toner And Carrier Particles" and Ser. No. 375,456 entitled "A Developing Station For The Development Of Charge Images."

BACKGROUND OF THE INVENTION

The invention relates to apparatus for use in a developer station where charge images formed on a charge image carrier passed through the developer station are inked in accordance with magnetic brush principles with a developer mix of toner and carrier particles and, more particularly, to means for adjusting the level of developer mix being carried on a developer drum to the inking area.

Typically, non-mechanical printing or copying machines function according to electrophotographic or xerographic principles, wherein electrostatic latent images of characters to be printed are generated on a charge image carrier, such as a photoconductive drum, and subsequently inked with a black powder called toner in a developer station. The toner images are subsequently transferred to sheet paper on which they are fixed. The developing station typically includes at least one developer unit generally referred to in the art as a magnetic brush developer. The magnetic brush developer, as a rule, contains a magnetic drum mounted for rotation so as to continually bring developer mix, consisting of iron carrier particles and toner particles, into contact with the electrostatic images recorded on the charge image carrier. The charge images are inked by adherence of toner particles to the charge images due to electrostatic forces. The magnetic drum conventionally comprises a rotating hollow cylinder with a stationary magnet arrangement mounted within. One known developer station assembly which functions in accordance with magnetic brush principles is disclosed in U.S. Pat. No. 3,882,821. A magnetic brush developer station may also include a magnetic roller disposed beneath the developer drum for transporting developer mix particles from the floor of the developer station to the developer roller. This transport roller conventionally comprises a rotating hollow cylinder with a stationary magnet arrangement mounted within.

The developer roller conducts developer mix through an inking gap formed between the developer roller and the moving surface of the charge image carrier for toner inking of the latent charge images. Uniform and efficient inking of the charge images on the charge image carrier requires that the developer mix carried by the developer drum be regulated so as to have a uniform layer thickness and density with the aid of a doctor or stripping device prior to the inking gap. If the layer of developer mix on the developer roller is too thin or of uneven thickness, inking of the charge image carrier may be erratic with pale and spotted character printing. If the layer of developer mix is too thick, the photoconductive surface layer on the charge image carrier may become damaged in the inking gap.

U.S. Pat. No. 3,882,821 discloses the use of a stripping plate adjacent the developer roller for leveling the layer of developer mix being passed to the inking gap, wherein the excess developer mix strip by the plate subsequently falls back into the lower region supply chamber of the developer station. The stripping plates are permanently fixed in the developer housing spaced at a predetermined distance from the developer roller and extending longitudinally therewith. However, a significant disadvantage occurs with the use of such a stripping plate in that toner will from time to time fall from the developer mix layer on the developer roller as a result of its own weight and deposit on the stripping plate. This toner deposit builds up over the course of the operating period and, consequently, is periodically passed back into subsequent developer mix layers passing to the inking gap. This chipping away of the toner deposit on the stripping plate causes uneven inking densities or black spots on the developed charge images and can also cause a blurred printing during development of the carrier images, which is unsuitable and may lead to unintelligible printing.

An object of the present invention is to provide a developer station with apparatus such that developer mix carried on the developer roller is evenly layered prior to passage through the inking gap and periodic build-up of toner deposits adjacent the developer roller are prevented, even in the case of high-speed printers or copiers.

SUMMARY OF THE INVENTION

In a developer station for an electrophotographic printing or copying machine, there is formed an inking gap between the charge image carrier passing through the developer station and the developer roller by which developer mix is conducted upwardly from the housing floor to the inking gap. Adjacent to the developer roller and disposed longitudinally therewith is a rotatable stripping roller for layering the thickness of developer mix being conducted by the developer roller to the inking gap. The stripping roller turns at a relatively constant speed in a direction of rotation corresponding to that of the developer roller. A guide plate surface is arranged beneath the stripping roller extending substantially concentric with the lower mix receiving portion of the developer roller and formed with an upper lead end which terminates beneath the developer roller so as to form a gap therebetween. This gap serves as a discharge opening through which developer mix particles stripped by the stripping roller are passed radially away from the developer roller. The gap is arranged such that an accumulation of developer mix occurs at the inlet to the nip area formed between the developer roller and the stripping roller, which accumulation produces a compression of the developer mix in the nip area and, thus, effects a substantially constant mixture density throughout the longitudinal length of the developer roller. The discharge of stripped developer mix through the gap is eased in that the guide plate lead end is sloped at the gap vertically away from the nip area.

In accordance with the preferred embodiment, the stripping roller is formed with an annular plastic sheath or layer covering to prevent voltage sparkovers between the developer roller and the stripping roller in case such a voltage differential should exist.

BRIEF DESCRIPTION OF THE DRAWING

The sole FIGURE is a schematic, side elevational cross-sectional view of a developer station constructed in accordance with the present invention.

DESCRIPTION OF THE PREFERRED EMBODIMENT

The FIGURE illustrates a developer station 10 for use in an electrophotographic printing or copying machine. A charge image carrier 12 in the form of a photoconductive drum is mounted for rotation in the machine in the direction indicated by the arrow for conducting charge images from suitable charging stations (not shown) to the developer station 10 for inking, and then to suitable transfer and cleaning stations (not shown). The developer station 10 is formed of a housing having an open upper end facing toward the moving surface of the charge image carrier drum 12. A magnetic developer drum 14, which may be of conventional construction, is disposed for rotation in the housing for conducting developer mix particles, consisting of toner and iron carrier particles, from a main body supply 16 disposed in the lower region of the housing to an inking gap formed between the developer roller and the charge image carrier in the direction of the arrows shown. The developer roller 14 comprises, for example, a rotating hollow cylinder and a stationary, fixed magnet assembly which is arranged inside the hollow cylinder.

Disposed for rotation within the lower region of the developer station for conducting developer mix particles from the main body supply 16 to the developer roller 14 is a magnet transport roller 18. The transport roller 18 is conventionally of a type comprising a rotating hollow cylinder having an annularly etched surface with a fixed magnet arrangement disposed therein.

A stripping roller 20 is disposed longitudinally along the developer roller 14 mounted for rotation in a direction corresponding to that of the developer roller. The stripping roller 20 is arranged adjacent to the developer roller for defining a nip area therebetween through which a developer mix layer of uniform thickness passes in route to the inking gap. The spacing of the stripping roller 20 from the developer roller 14 determines the layer thickness of developer mix on the developer roller and can be adjusted, such as, for example, by mounting the stripping roller journals in eccentric shaped sleeves. The direction of rotation of the stripping roller 20 is identical to that of the developer roller 14 so that at the point of contact with the developer mix the stripping roller strips away an upper portion of the developer mix layer to produce an even thickness layer for passage through the nip area and onto the inking gap. The stripping roller 20 is disposed for continuous rotation at a constant speed, such that the roller surface is continuously automatically cleaned due to the stripping effect. In this manner, no toner can deposit on the stripping roller.

Disposed beneath the stripping roller 20 and generally concentric with a lower end region of the developer roller 14 is a guide plate means 22 having an upper lead end spaced beneath the stripping roller 20 for defining a gap 24 therebetween. The rotation of the stripping roller 20 causes the stripped off developer mix particles to discharge radially away from the developer roller 14 through the gap 24 in the direction of the arrows shown. The guide plate 22 extends longitudinally along the length of the developer roller 14 as well as the stripping roller 20. The gap 24 serves a discharge opening and this opening is sized such that a small accumulation of developer mix forms at the entry point to the stripping and developer rollers nip area. This build-up or accumulation of developer mix adjacent the nip area produces a compression of the developer mix layer passing through the nip area for effecting a uniform mix density along the entire length of the developer roller 14 in the mix layer passing through the nip area onto the inking gap.

In accordance with the preferred embodiment, the stripping roller 20 may, for example, have a diameter of 20 mm, in which case the dimension of the gap opening 24 between the lower end of the stripping roller 20 and the lead end of the guide plate 22 can, for example, be about 5 mm. The gap opening 24 must be sized such that it is not too small, which would cause an accumulation of the developer mix adjacent the nip area which is too large and could lead to pinching or blocking of the movement of the stripping and developer rollers. In order to ease the discharge of stripped off developer mix particles from building up too heavily adjacent the nip area, the lead end of the guide plate 22 is sloped vertically downward away from the nip area.

Upon discharge of the excess developer mix particles from the gap 24, these particles spill back toward the lower region of the developer station housing onto the main mix body 16 for recycling.

It has been found that improved charge image development can be achieved by applying a direct current voltage amounting to a few hundred volts to the developer roller 14. The presence of such voltage can, however, lead to the danger of voltage sparkovers from the developer roller 14 to the stripping roller 20. In order to prevent such voltage sparkovers, a plastic sheath or layer covering 26, which may be VITON-brand plastic, is disposed about the annular surface of the stripping roller 20. In accordance with the preferred embodiment, this plastic sheath 26 may be assembled onto the stripping roller 20 in the form of shrinkage tube.

The developer station 10 may further include a pair of rotary mixing screws 28. One screw is disposed within the main body of developer mix 16 for blending together the toner and carrier particles and for conducting developer mix continuously from one end of the station housing to the opposed end. The other screw serves primarily to conduct fresh toner particles into the main body of mix at the one end of the housing for replenishing the toner concentration in the mix.

The developer station may also include a carrier collecting roller 30 disposed for rotation at the exit end of the developer station from which the charge image carrier 12 emerges. Such a carrier collecting roller 30 may comprise a hollow cylinder mounted for rotation in a direction corresponding to the direction of rotation of the image carrier drum and a fixed magnet assembly disposed inside the rotating cylinder. The carrier collecting roller 28 serves to remove carrier particles which may have become adhered to the charge image carrier 12 in the inking gap.

Since the stripping mechanism of the present invention is designed as a roller 20 which continuously rotates, no toner can deposit on this roller. In this manner, the risk of high density spotting in the inking of the charge images, as well as uneven inking quality, is reduced. In addition, toner deposits on the lead edge of the guide plate 22 are prevented from forming in that a discharge flow of developer mix is continuously transported by virtue of the rotation of the stripping roller 20 past this edge. Uniform inking quality is achieved by virtue of the invention assembly since a uniform layer thickness of developer mix is conducted to the inking gap and this mix layer is of a uniform density due to the compression step brought about by the accumulation of developer mix particles at the inlet to the nip area between the stripping roller 20 and the developer roller 14.

Although various minor modifications may be suggested by those versed in the art, it should be understood that we wish to embody within the scope of the patent warranted hereon all such modifications as reasonably and properly come within the scope of our contribution to the art.

We claim as our invention:

1. In a developer station having a housing containing a rotary developer drum for conducting developer mix, including toner and carrier particles, from a lower region of said housing to an inking gap between said developer drum and a charge image carrier passing through said station for developing charge images generated on said carrier, apparatus for setting the layer of developer mix on said developer drum being passed to said inking gap comprising:

a stripping roller mounted for constant speed rotation in a direction corresponding to the direction of rotation of said developer drum and disposed adjacent to said developer drum for defining a nip area therebetween through which developer mix carried by said developer drum passes in route to said inking gap, said stripping roller coacting with said developer drum across said nip area to uniformly set the layer of developer mix being passed therebetween to said inking gap at a constant height and a guide plate disposed beneath said stripping roller and adjacent said developer drum, said guide plate having a lead edge spaced beneath said stripping roller by a gap opening for receiving therethrough developer mix stripped by said stripping roller in said nip area.

2. The apparatus of claim 1, wherein said gap opening is sized such that an accumulation of stripped developer mix occurs at the inlet to said nip area for compressing developer mix entering said nip area to substantially uniform density.

3. The apparatus of claim 2, wherein said lead edge is sloped vertically downward from said nip area.

4. The apparatus of claim 1, wherein said lead edge is sloped vertically downward from said nip area.

5. The apparatus of claim 1, wherein said stripping roller is surrounded by a plastic sheath.

* * * * *